US005429715A

United States Patent [19]

Thomas et al.

[11] Patent Number: 5,429,715

[45] Date of Patent: Jul. 4, 1995

[54] METHOD FOR RENDERING IMAGING MEMBER SUBSTRATES NON-REFLECTIVE

[75] Inventors: Mark S. Thomas, Williamson; Phillip G. Perry, Webster; David J. Maty, Ontario; Richard J. Manzolati, Rochester; Gene W. O'Dell, Williamson, all of N.Y.

[73] Assignee: Xerox Corporation, Stamford, Conn.

[21] Appl. No.: 143,709

[22] Filed: Nov. 1, 1993

[51] Int. Cl.[6] ..... C23F 1/00

[52] U.S. Cl. ..... 216/103; 252/79.1; 252/79.2; 252/79.5; 216/106

[58] Field of Search ..... 156/656, 664, 665, 666; 252/79.1, 79.2, 79.4, 79.5; 134/2, 3, 41, 1

[56] References Cited

U.S. PATENT DOCUMENTS

| | | | |
|---|---|---|---|
| 4,076,564 | 2/1978 | Fisher | 156/664 |
| 4,138,262 | 2/1979 | Wacks et al. | 156/664 X |
| 4,770,965 | 9/1988 | Fender et al. | 430/66 |
| 4,857,225 | 8/1989 | Terada et al. | 134/3 X |
| 4,936,948 | 6/1990 | Ohki et al. | 156/665 X |
| 5,030,536 | 7/1991 | Pai et al. | 156/662 X |
| 5,052,421 | 10/1991 | McMillen | 134/2 |
| 5,085,732 | 2/1992 | Nakamura et al. | 156/656 |
| 5,096,796 | 3/1992 | Mammino et al. | 430/67 |
| 5,232,512 | 8/1993 | Swain | 134/7 |

*Primary Examiner*—Thi Dang

*Attorney, Agent, or Firm*—Oliff & Berridge

[57] ABSTRACT

A method of rendering nonreflective an imaging member substrate, preferably a photoreceptor substrate, involves etching the substrate with (a) an effective amount of an etching agent at a temperature sufficient to effect etching of the substrate, wherein the etching agent comprises (i) high purity deionized water, (ii) a mixture of high purity deionized water and a mild acid or (iii) a mixture of high purity deionized water and a base; or (b) a combination of the etching agent (a) and modulating ultrasonic energy.

This method renders the substrate clean, spotless, and pristine, and provides it with uniform surface roughness.

26 Claims, No Drawings

METHOD FOR RENDERING IMAGING MEMBER SUBSTRATES NON-REFLECTIVE

BACKGROUND OF THE INVENTION

This invention relates to imaging members and to methods of providing imaging member substrates with nonreflective surfaces.

Embodiments of imaging member substrates to be used in xerographic printers employing laser light should have a non-reflective surface. If the surface is reflective, the resulting printed copy will have an undesirable defect referred to as "plywood". Plywood is a print quality defect that results from non-uniform discharge of an imaging member. The defect consists of a series of dark and light interference fringes which occur when a multilayered imaging member is used under a coherent illumination source, e.g., a laser beam. The interference fringes are caused by the reflection of the incident beam of coherent light from the imaging member's interfaces. Specifically, the reflections from the top surface and from the metal ground plane (the substrate) cause most of the interference. The interference can be avoided by eliminating or suppressing the strong substrate reflection. This is generally accomplished by roughening the surface of the substrate.

Methods of rendering imaging member substrates non-reflective include, for example, anodizing the substrate surface, dry blasting, adding scattering materials, coating the substrate with an opaque and nonreflective layer, critical machining which uses special diamond cutting tool designs, and roughening the substrate surface by honing techniques, e.g., wet honing by means of glass or ceramic beads or spray honing wherein the substrate surface is sprayed with particulates in water media.

Each of the foregoing methods requires the additional step of subsequent washing of the substrate. Coating the substrate with an opaque and non-reflective layer requires not only a subsequent washing step but also additional materials, i.e., the materials used in the opaque and non-reflective layer, and the additional step of applying the layer and curing it. Critical machining processes using special diamond cutting tool designs are demanding and have tight process latitudes, resulting in diamond wearout and usage with lower yields and throughput. Honing media are expensive, which leads to high processing costs. Spray honing is also a source of contamination defects on the substrate. Furthermore, startup and shutdown of the spray apparatus causes spray material to dry on the nozzle, which contributes to process and defect problems. Spray honing also involves waste containment costs and a risk of environmental pollution.

Methods for rendering imaging member substrates non-reflective must not only eliminate or suppress strong substrate reflection, but they must do so without affecting the electrical parameters or the print quality of the imaging member. Furthermore, the method should render the substrate surface clean and give it uniform roughness and allow the substrate to remain hydrophobic.

SUMMARY OF THE INVENTION

The present invention provides a method of rendering an imaging member substrate non-reflective, comprising etching the substrate with (a) an effective amount of an etching agent at a temperature sufficient to effect etching of the substrate, wherein the etching agent comprises (i) high purity deionized water, (ii) a mixture of high purity deionized water and a mild acid or (iii) a mixture of high purity deionized water and a base; or (b) a combination of the etching agent (a) and modulating ultrasonic energy.

The method of this invention does not require a subsequent washing step and renders the substrate nonreflective without affecting the imaging member's electrical parameters or print quality. The method of this invention also renders the substrate clean, spotless, pristine and provides the substrate with uniform roughness.

DETAILED DESCRIPTION OF PREFERRED EMBODIMENTS

In the method of this invention, the substrate is etched with an effective amount of an etching agent or with a combination of the etching agent and modulating ultrasonic energy.

Substrates which may be etched according to the method of this invention include, for example, aluminum, magnesium, copper, and zinc alloys such as brass. Aluminum is the preferred substrate.

An "effective amount" of the etching agent is that amount which is effective to etch the substrate so as to render it non-reflective.

i) The term "deionized water" as used herein refers to water which has been demineralized by removal of inorganic constituents. The term "high purity deionized water" as used herein refers to deionized water generally having a resistivity of at least 1M ohm-cm and preferably in the range of from about 4 to about 18M ohm-cm.

ii) The mild acid preferably possesses chelating or sequestering qualities which allow it to chelate or sequester heavy metals. The term "mild" with respect to the acid means that the acid is mild enough not to attack any metal oxide on the substrate surface. Furthermore, the acid should not eliminate hydrophobic properties of the substrate.

The acid should be water-soluble to the extent of its concentration level in the deionized water/acid mixture. The amount of acid in the deionized water/acid mixture is preferably that amount sufficient to give the mixture a pH ranging from about 2 to about 7 and most preferably ranging from about 6 to about 7. The amount of acid should range from about 0.1% to about 1.5% and most preferably should be about 1% by weight of the deionized water/acid mixture.

Examples of suitable mild acids for use in this invention include organic acids, weak mineral acids and dilute strong acids.

Suitable organic acids include carboxylic acids, dicarboxylic acids, hydroxy acids, acids containing both hydroxy and carboxylic groups, and acids containing both hydroxy and amino groups. Examples of specific suitable organic acids include citric acid, glutamic acid, lactic acid, tartaric acid, oxalic acid, and the like, as well as mixtures of the foregoing.

Weak mineral acids and dilute strong acids suitable for use in this invention include, for example, nitric acid, phosphoric acid and dilute sulfuric acid.

The most preferred acid for use in this invention is citric acid.

iii)Examples of suitable bases include sodium hydroxide, sodium carbonate, sodium bicarbonate and sodium borate. The deionized water/alkaline solutions have a preferred pH range of 10–12 with a concentration range of about 1–5% by weight. The carbonate and hydroxide salts provide for the dissolution of aluminum (which renders a water-break-free surface), while the borate provides detergent and sequestering qualities.

The preferred etching agent for use in this invention is an aqueous mixture of sodium carbonate and sodium borate. Preferably, sodium carbonate and sodium borate will each be present at about 3% by weight of the aqueous mixture.

The etching agent used in this invention should be substantially free of honing particles. Preferably, the etching agent is completely free of honing particles.

The temperature of the etching agent during the etching of the substrate is that temperature sufficient to effect etching of the substrate. Preferably, this temperature will be at least 60° C. and more preferably in the range of from about 70° C. to about 80° C.

Any suitable etching technique may be used in the method of this invention, for example, spraying, dipping, flowing, immersion and the like. Preferably, etching is carried out by running the substrate under a flow of the etching agent or by immersing the substrate into a bath of the etching agent.

In an especially preferred embodiment, cavitation is applied to the etching agent to assist in etching the substrate. Preferably, the cavitation is applied to the etching agent via ultrasonic energy at a frequency ranging from about 25 to about 55 cycles per second and more preferably from about 38 to about 42 cycles per second.

Any suitable technique for applying ultrasonic energy to the etching agent may be used. Piezoelectric transducers are most preferred for applying the ultrasonic energy. The transducers may be mounted externally to the processing vessel, e.g., on the bottom and/or sides. Alternatively, the transducers may be used submerged in the etching solution.

The substrate is contacted with the etching agent or etching agent/ultrasonic energy combination for a time sufficient to etch the substrate. The period of contact will depend on such factors as the type of etching agent, type of substrate, temperature of the etching agent, the use and amount of ultrasonic energy. Typically, the period of contact will be at least 2 minutes when the etching agent is citric acid having a temperature of 60° C. or higher and accompanied by ultrasonic energy applied at a level of 25 to 55 cycles per second, and the substrate is aluminum.

After the substrate is etched, it is preferred but not always necessary to rinse the substrate with water, preferably deionized water. Rinsing may be carried out by any suitable rinsing technique, for example, by spraying, dipping, flowing, cascading, immersing and the like. Preferably, the substrate is rinsed by flowing water over it.

After the substrate is etched, it may be coated with any suitable coatings to fabricate an electrostatographic imaging member, e.g., an electrophotographic imaging member or an ionographic imaging member.

To form electrophotographic imaging members, the etched substrate may be coated with a blocking layer, a charge generating layer, and a charge transport layer. Optional adhesive, overcoating and anti-curl layers may also be included. Alternatively, a single photoconductive layer may be applied to the substrate. If desired, the sequence of the application of coatings of multilayered photoreceptors may be varied. Thus, a charge transport layer may be applied prior to the charge generating layer. The photoconductive coating may be homogeneous and contain particles dispersed in a filmforming binder. The homogeneous photoconductive layer may be organic or inorganic. The dispersed particles may be organic or inorganic photoconductive particles. Thus, for the manufacture of electrophotographic imaging members, at least one photoconductive coating is applied to the etched substrate.

Ionographic imaging members can be formed by coating the etched substrate with a conductive layer, a dielectric imaging layer, and an overcoating layer.

In preferred embodiments, the imaging member substrate etched according to the method of this invention is a photoreceptor substrate.

Experimental

An aluminum substrate is etched with an etching agent containing a sodium hydroxide aqueous solution. The substrate surface is rendered roughened and exhibits no plywood phenomenon.

What is claimed is:

1. A method of rendering an imaging member substrate non-reflective, comprising selecting a temperature and a composition comprising deionized water having a resistivity greater than about 4M ohm-cm to effect etching of the substrate, and contacting said substrate with said composition at said temperature to effect etching.

2. A method according to claim 1, wherein the composition consists essentially of high purity deionized water.

3. A method according to claim 1, wherein the composition comprises a mixture of high purity deionized water and a mild acid.

4. A method according to claim 1, wherein the composition comprises a mixture of high purity deionized water and a base.

5. A method according to claim 4, wherein the base is a mixture of sodium carbonate and sodium borate.

6. A method according to claim 1, wherein the selected temperature is at least 60° C.

7. A method according to claim 1, wherein the selected temperature ranges from about 70° C. to about 80° C.

8. A method according to claim 1, comprising selecting a pH for the said contacting step from about 2 to about 7.

9. A method according to claim 1, comprising selecting a pH for said contacting step from about 6 to about 7.

10. A method according to claim 1, comprising selecting a pH for said contacting step from about 10 to about 12.

11. A method according to claim 1, wherein the deionized water has a resistivity of at least 1M ohm-cm.

12. A method according to claim 1, wherein the deionized water has a resistivity ranging from about 4 to about 18M ohm-cm.

13. A method according to claim 3, wherein the acid is a chelating acid.

14. A method according to claim 3, wherein the acid is an organic acid, a weak mineral acid or a dilute strong mineral acid.

15. A method according to claim 3, wherein the acid is citric acid.

16. A method according to claim 4, wherein the base is sodium carbonate or sodium hydroxide.

17. A method according to claim 1, further comprising applying modulating ultrasonic energy to the composition.

18. A method according to claim 17, wherein the modulating ultrasonic energy is applied to the composition at a frequency ranging from about 25 to about 55 cycles per second.

19. A method according to claim 1, wherein the substrate is aluminum, magnesium, copper, or a zinc alloy.

20. A method according to claim 1, wherein the imaging member is a photoreceptor.

21. A method according to claim 1, further comprising the step of rinsing the etched substrate with rinse water.

22. A method according to claim 21, wherein the rinse water is deionized water.

23. A method according to claim 1 of rendering an imaging member substrate non-reflective, comprising contacting the imaging member substrate with a composition that is substantially free of honing particles.

24. A method according to claim 1 of rendering an imaging member substrate non-reflective, comprising contacting the imaging member substrate with a composition that is completely free of honing particles.

25. A method of rendering an imaging member substrate non-reflective, comprising etching the substrate with an effective amount of an etching agent at a temperature sufficient to effect etching of the substrate, wherein the etching agent comprises a mixture of high purity deionized water having a resistivity ranging from greater than about 4M ohm-cm and a base and the base is a mixture of sodium carbonate and sodium borate.

26. A method of rendering an imaging member substrate non-reflective, comprising etching the substrate with an effective amount of an etching agent at a temperature sufficient to effect etching of the substrate, wherein the etching agent comprises high purity deionized water having a resistivity ranging from greater than about 4M ohm-cm and a mild acid, wherein the acid is citric acid.

* * * * *